United States Patent [19]

Marino

[11] Patent Number: 4,860,422

[45] Date of Patent: Aug. 29, 1989

[54] REBUILDING OF THE STACK, BOSH AND HEARTH OF A BLAST FURNACE USING A REMOTE CONTROLLED REFRACTORY GUNNING DEVICE

[75] Inventor: Joseph J. Marino, New York, NY

[73] Assignee: Quigley Company, Inc., New York, N.Y.

[21] Appl. No.: 103,982

[22] Filed: Oct. 1, 1987

[51] Int. Cl.[4] ..... C21B 5/00; C21B 13/00; C21B 15/00

[52] U.S. Cl. ..... 29/402.18; 266/44; 75/41

[58] Field of Search ..... 29/402.18, 402.01; 75/41; 239/226; 266/281, 44

[56] References Cited

U.S. PATENT DOCUMENTS 4,577,385 3/1986 Omae et al. ..... 29/402.18

4,793,595 12/1988 Head et al. ..... 75/41

*Primary Examiner*—Howard N. Goldberg
*Assistant Examiner*—Taylor J. Ross
*Attorney, Agent, or Firm*—Peter C. Richardson; Lawrence C. Akers; Robert F. Sheyka

[57] ABSTRACT

The disclosed process uses a vertical remote controlled refractory gunning apparatus to repair damages to the stack, bosh, or hearth of a blast furnace. In the disclosed method, a reusable opening is created in the side of the blast furnace and a gantry, for example, is inserted through the reusable opening. The vertical remote-controlled refractory gunning apparatus is then introduced into the blast furnace via the gantry. In those cases wherein the blast furnace is loaded through a chute, the chute is moved to one side, the gantry is introduced at an angle and the vertical remote controlled refractory gunning apparatus is introduced through the opening.

4 Claims, 7 Drawing Sheets

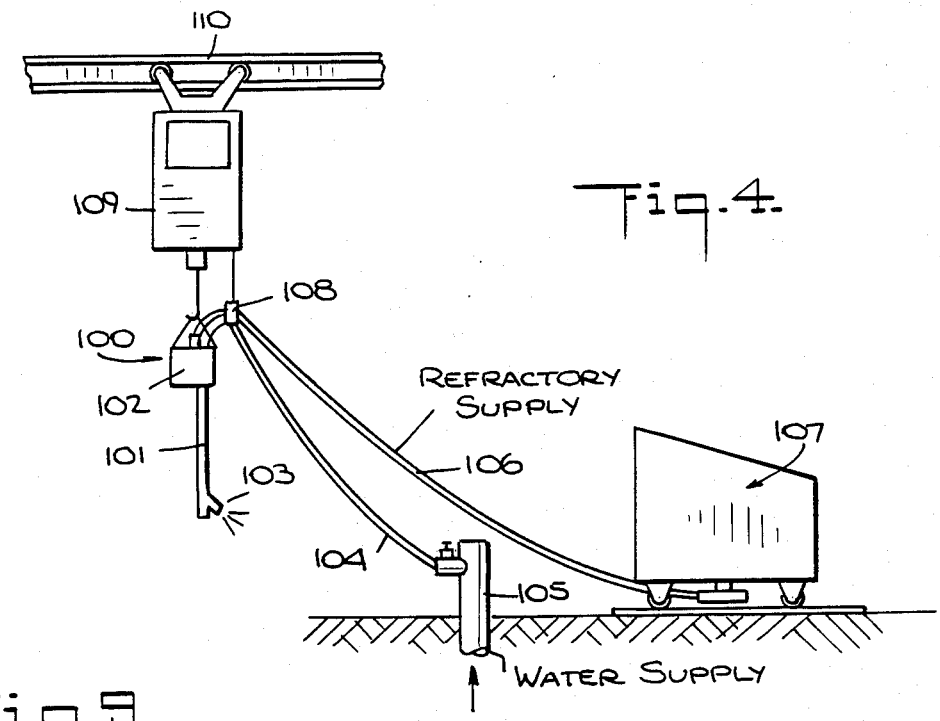
Fig. 4.
Fig. 9.
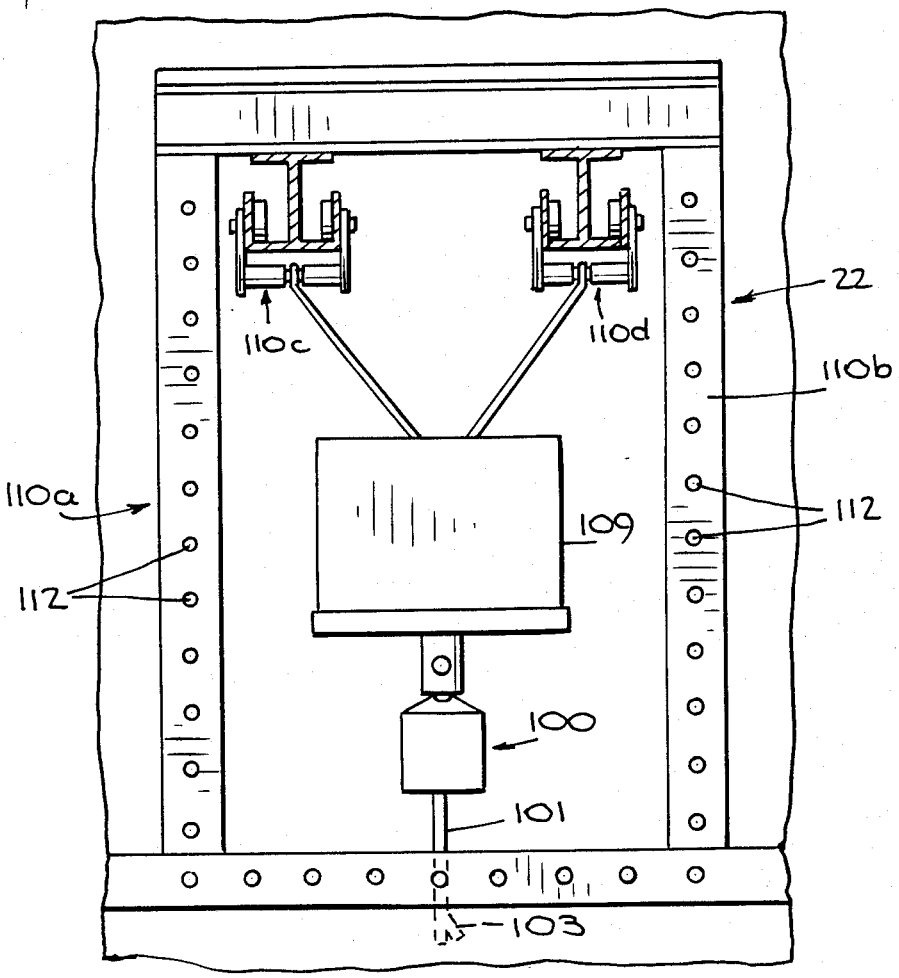

REBUILDING OF THE STACK, BOSH AND HEARTH OF A BLAST FURNACE USING A REMOTE CONTROLLED REFRACTORY GUNNING DEVICE

BACKGROUND OF THE INVENTION

The present invention relates to a process for the repair of blast furnaces. More specifically, it relates to a method of repairing blast furnaces using a vertical remote controlled refractory gunning apparatus.

Blast furnaces are used to melt iron and cast the resulting product from the blast furnace in a molten form. While once a major source for the domestic production of steel, the number of blast furnaces operating in the U.S. has declined rapidly. In the late 1970's, approximately 120 furnaces operated in the U.S. Currently, there are 35 operating blast furnaces in the U.S. with the number expected to decline to between 20 and 30 by 1990.

While the number of blast furnaces has declined, the remaining furnaces are producing a steady amount of iron, which means that iron production per blast furnace per year is increasing. To maintain this continued increased production, the blast furnaces must be in operation for longer periods of time. Due to this increased working time, it is highly desirable to avoid a total shutdown of the blast furnace. Thus, there remains a need for an efficient process for maintaining a blast furnace which will allow the blast furnace to be repaired without an expensive, time-consuming, total shutdown.

A number of processes and devices for repairing various steel making vessels are known.

U.S. Pat. No. 4,577,385 discloses a method for repairing the wall of a combustion chamber, such as a coke oven. In the disclosed method, a lance containing a light generating optical system is introduced through a preexisting opening into the inside of the combustion chamber.

U.S. Pat. No. 4,649,858 discloses a repairing apparatus for an industrial furnace which comprises a plasma spray gun capable of being moved in a three-dimensional direction relative to the area of the furnace wall to be repaired. By controlling the spray distance of the plasma flame, repairs can be made to uneven areas of damage.

In U.S. Pat. No. 4,150,176, the tubular refractory vessel is disposed so that the longitudinal axis running therethrough is horizontal and a moist refractory mass is slung onto the longitudinal or annular sections.

The vertical remote controlled refractory gunning apparatus disclosed in U.S. Pat. No. 3,799,445 is said to be useful for repairing stationary furnaces and is introduced through the top of the stationary furnace.

The refractory gunning device disclosed in U.S. Pat. No. 4,181,258 is also introduced through the top of a stationary furnace.

According to Col. 4, lines 12–22 of U.S. Pat. No. 4,272,018, the disclosed refractory spraying device is lowered into the vessel to be sprayed.

U.S. Pat. No. 4,211,367 discloses a refractory gunning device that may be used in a blast. furnace while the walls are still at elevated temperatures. The disclosed device is preferably lowered into the blast furnace. See Col. 10, lines 54–65 and see also U.S. Pat. No. 4,272,020.

Other methods of repairing blast furnaces are also used. For instance, long pipe gunning is a manual method wherein multiple openings are created in the blast furnace shell and refractory is gunned onto the stack wall at various angles, producing significant amounts of rebound (wasted refractory that does not adhere).

Manual gunning requires a complete shutdown of the furnace. After the furnace has cooled, men must enter the furnace on erected scaffolds and gun the stack at close range.

Grouting, or the use of injectable refractories, requires that a refractory mixture be pumped through nozzles that have been mounted on the outside stack wall. Refractory material then fills the void between the burden (stack of raw materials) and the shell. The effectiveness of this method is questionable.

Thus, there remains a need for effective, on-line repair and maintenance method for blast furnaces.

BRIEF DESCRIPTION OF THE DRAWINGS

FIG. 4 depicts a vertical remote controlled refractory gunning apparatus device useable in the process of the present invention.

FIG. 9 is a cross sectional view taken through line 9—9 of FIG. 8 and depicts the attachment of the gantry to the doorway.

SUMMARY OF THE INVENTION

Figure 1:
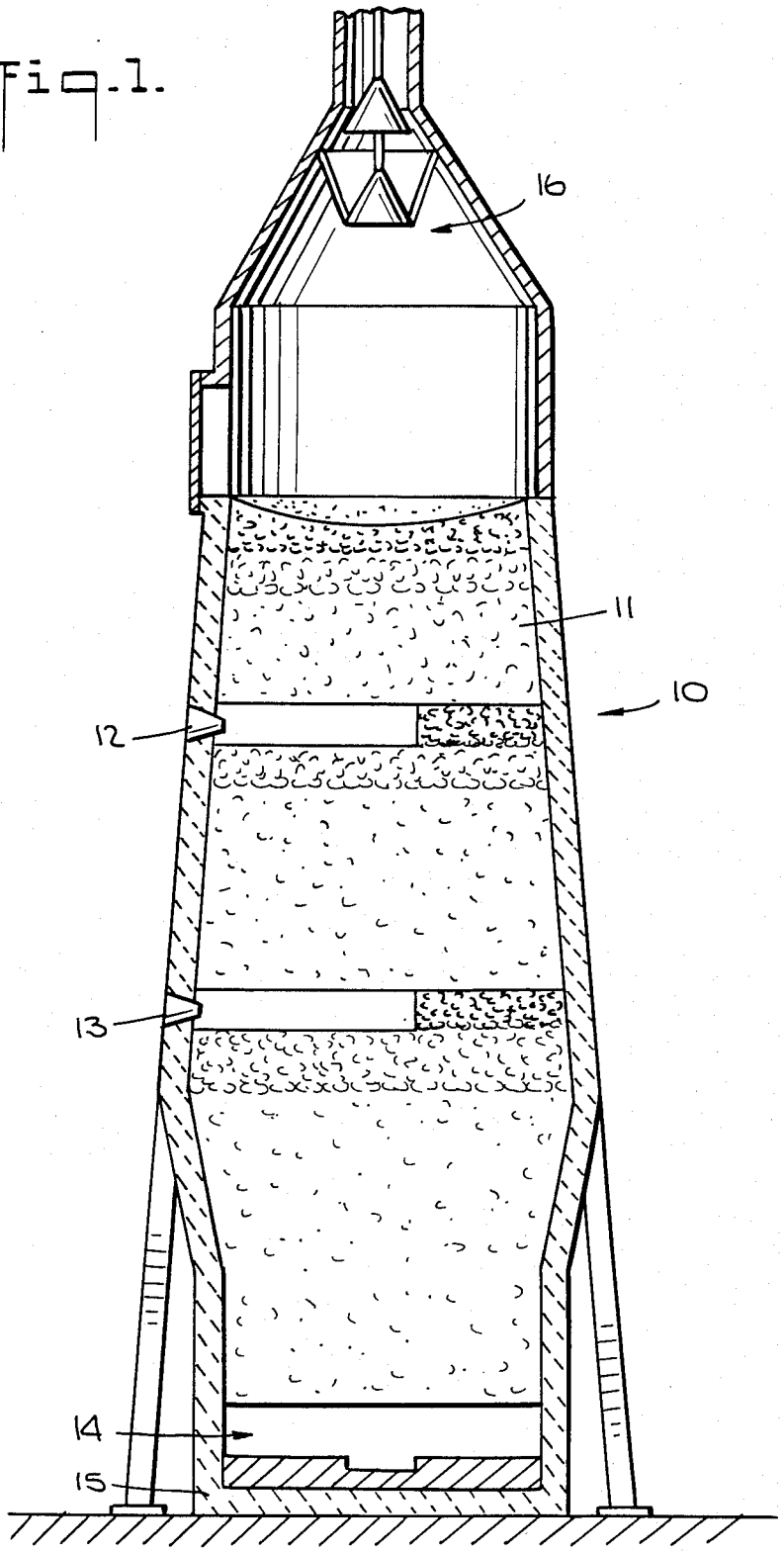
FIG. 1 is a vertical cross-section of a typical blast furnace.

The present invention is directed to a method of repairing an area of damages to the wall of the stack, bosh or hearth of a blast furnace comprising a) withdrawing raw material present in the blast furnace to a point below the area to be repaired, b) creating a reusable opening in the side of said blast furnace, said opening located in the vicinity of the stock line of said furnace, c) introducing through said opening means supporting a vertical remote-controlled refractory gunning apparatus, said vertical remote-controlled refractory gunning apparatus comprising (i) a vertical gunning conduit, (ii) a control unit, (iii) bearing means rotatably connecting and mounting said vertical gunning conduit from said control unit;

(iv) an oscillating drive in said control unit (v) a drive coupling in said control unit connecting said oscillating drive to said vertical gunning conduit, (vi) supply conduits entering said control unit for supplying refractory material and water, (vii) a mixing head in said control unit to which said supply conduits are connected, (viii) a swivel coupling connecting said mixing head to said vertical gunning conduit for providing a mixture of water and refractory to said nozzle, and (ix) actuating means connected to said oscillating drive for selectively actuating it to control the angular orientation of said nozzle whereby said nozzle is angularly oriented about said vertical gunning conduit in stationary and oscillating modes of operation, d) spraying refractory material onto the area to be repaired.

In a preferred embodiment, the reusable opening is a flanged doorway.

In another preferred embodiment, the supporting means is a gantry.

In another aspect, the present invention is directed to a process for the repair of an area of damages to the stack, bosh or hearth of a blast furnace having chute means for the introduction of raw material comprising angularly disposing said chute means to one side and introducing through the opening formed by said angular disposition of said chute means means supporting a vertical remote controlled refractory gunning apparatus, said supporting means angularly disposed at a minimum angle to clear said chute, said vertical remote controlled refractory gunning apparatus comprising:

(i) a vertical gunning conduit, (ii) a control unit, (iii) bearing means rotatably connecting and mounting said vertical gunning conduit from said control unit, (iv) an oscillating drive in said control unit, (v) a drive coupling in said control unit connecting said oscillating drive to said vertical gunning conduit, (vi) supply conduits entering said control unit for supplying refractory material and water, (vii) a mixing head in said control unit to which said supply conduits are connected, (viii) a swivel coupling connecting said mixing head to said vertical gunning conduit for providing a mixture of water and refractory to said nozzle, and (ix) actuating means connected to said oscillating drive for selectively activating it to control the angular orientation of said nozzle whereby said nozzle is angularly oriented about said vertical gunning conduit in stationary and oscillating modes of operation, d) spraying refractory material onto the area to be repaired.

In a preferred embodiment, the supporting means is a gantry.

In a preferred embodiment, the minimum angle at which the supporting means is introduced is about 25°.

DETAILED DESCRIPTION OF THE INVENTION

Referring now to the Drawings, it can be seen that FIG. 1 shows a blast furnace 10 which is loaded with raw materials or burden 11 generally consisting of iron ore, coke and limestone. The particular sections of the blast furnace are also shown in FIG. 1. It can be seen that blast furnace 10 consists of a stack 12 which is the upper portion of the blast furnace 10 where the burden 11 is preheated and prereduced. Proceeding down the length of blast furnace 10, the bosh 13 is the inverted conical section of blast furnace 10 where the melting starts. The lower portion of blast furnace 10 where the metal add slag collect is the hearth 14. The molten metal is removed from the hearth 14 to iron notch 15 and then to transfer ladles (not shown). Also shown in FIG. 1 is big bell 16 which delivers burden 11 to blast furnace 10.

Figure 2:
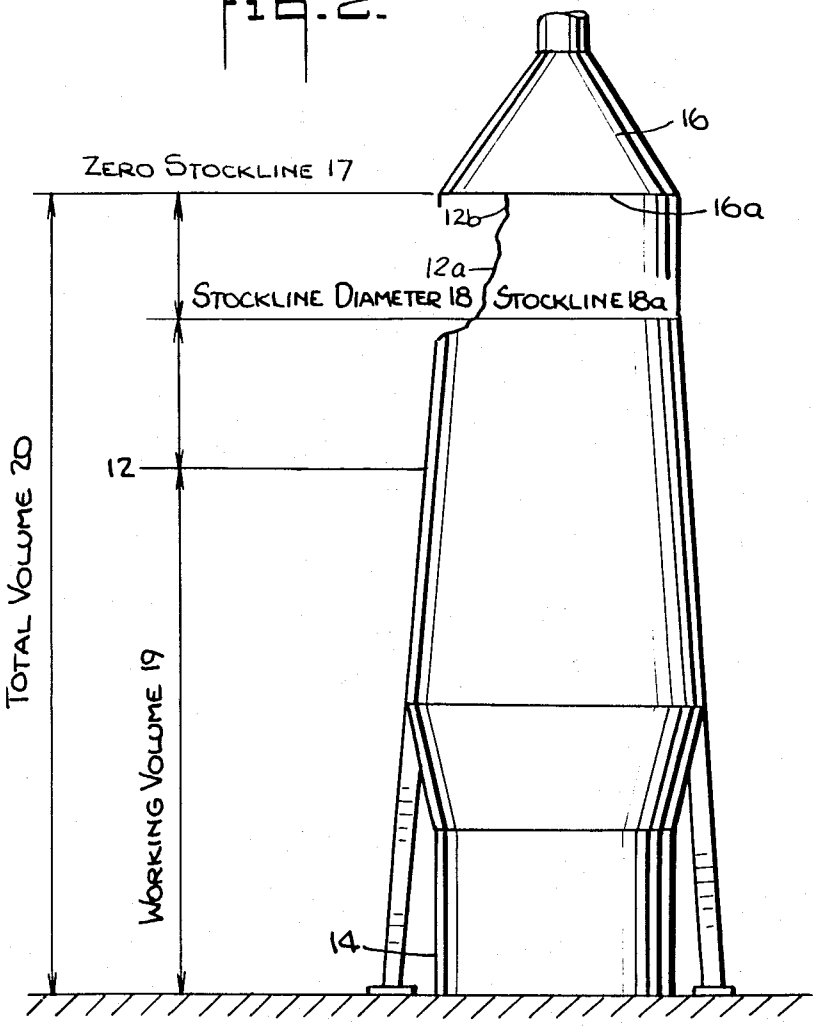
FIG. 2 shows the top of the blast furnace of FIG. 1 and also shows the location of the stockline.

Referring to FIG. 2, it can be seen that the top section **12*a* of blast furnace 10 is located above stack 12 with the top 12*b* of top section 12 receiving big bell 16. The bottom face 16*a* of big bell 16 forms a horizontal plane when big bell 16 is in the closed position. This horizontal plane forms zero stockline 17. Thus, stockline diameter 18 would be located in a plane six feet below zero stockline 17 with the portion of stockline diameter 18 within blast furnace 10 being stockline 18*a*. The working volume 19 of blast furnace 10 extends from hearth 14 to stockline diameter 18 while the total volume 20 extends from hearth 14 to zero stockline 17**.

Figure 3:
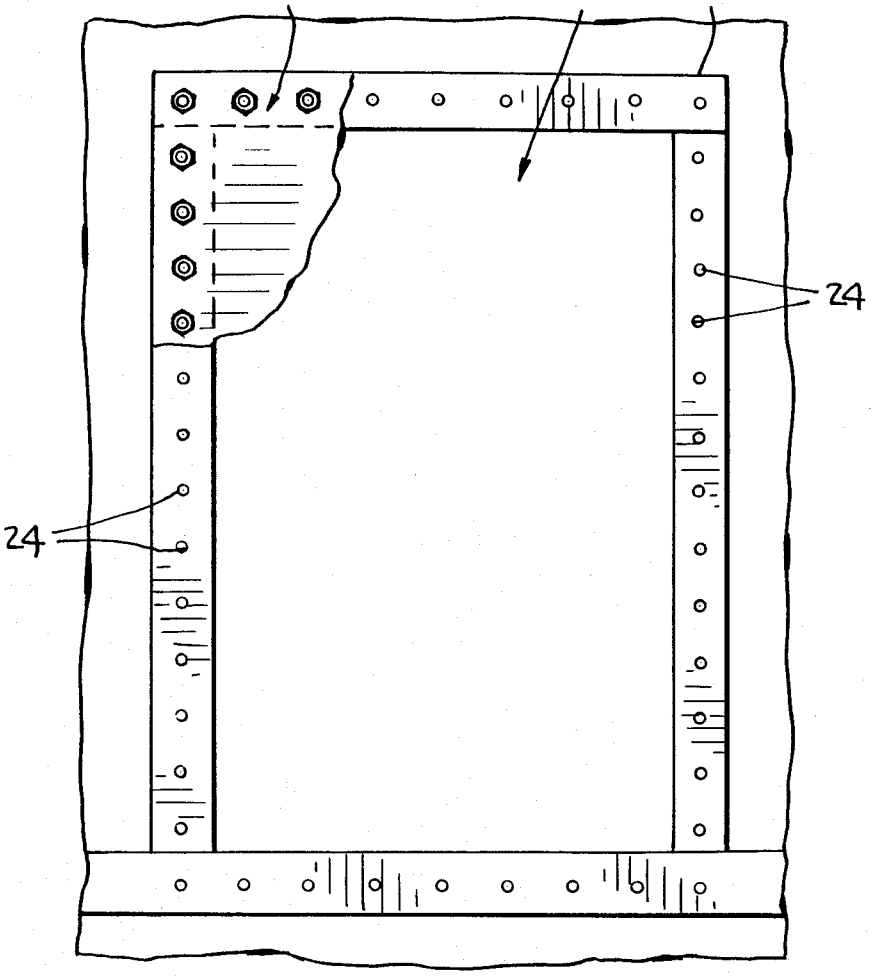
FIG. 3 depicts the construction of a reusable opening in blast furnace 10.

Referring to FIG. 3, a reusable opening 21 is illustrated as being framed by door frame 22 from which door 23 (shown in a sectional view) has been removed. In door frame 22 are located throughbores 24, which, in addition to serving as fastening points for bolting door 23 to door frame 22, also serve to anchor gantry 110 to the blast furnace wall, as will be described in further detail below. Although FIG. 3 illustrates the reusable opening 21 as sealed by a removeable door, other types of openings may be used. For example, a flanged door resting on tracks may be used in which case the door may slide sidewardly, upwardly or downwardly. Other reusable openings such as double outward opening doors may also be used.

The vertical remote controlled refractory gunning apparatus used in the process of the present invention is disclosed in U.S. Pat. No. 3,799,445 while a sequential gunning apparatus with a television camera is disclosed in U.S. Pat. No. 4,301,998, the disclosures of both patents being incorporated herein by reference.

Briefly, as shown in FIG. 4, the gunning apparatus 100 includes a rotatable vertical gunning conduit 101 extending from control box 102 terminating at its lower extremity in a nozzle 103. Preferably nozzle 103 extends from gunning conduit 101 at substantially a right angle as shown, although either an acute or obtuse angle may be employed. Conduit 104 supplies water to control box 102 from hydrant 105. Conduit 106 supplies a dry refractory mixture from supply tank or so called refractory gun 107 which is manually replenished through its open top. Conduits 104 and 106 are suspended in a sling 108 extending from cab 109 of overhead gantry 110, to be described in greater detail later.

Figure 5:
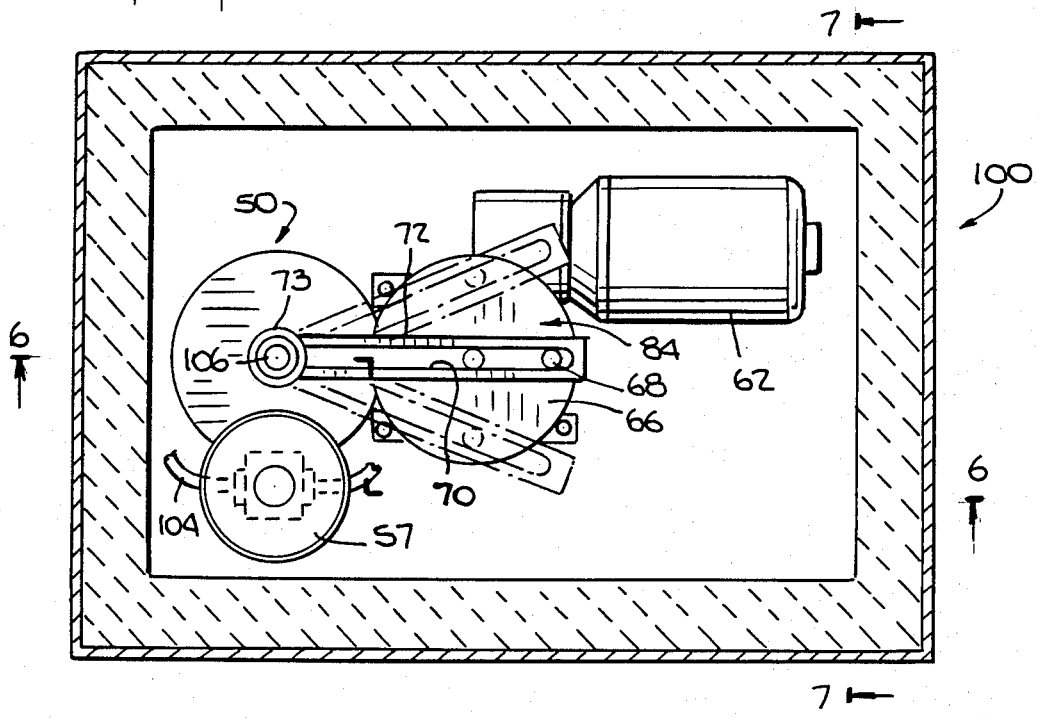
FIG. 5 is a top plan view of the driving and mixing compartment of the embodiment shown in FIG. 4 with cover removed.
Figure 6:
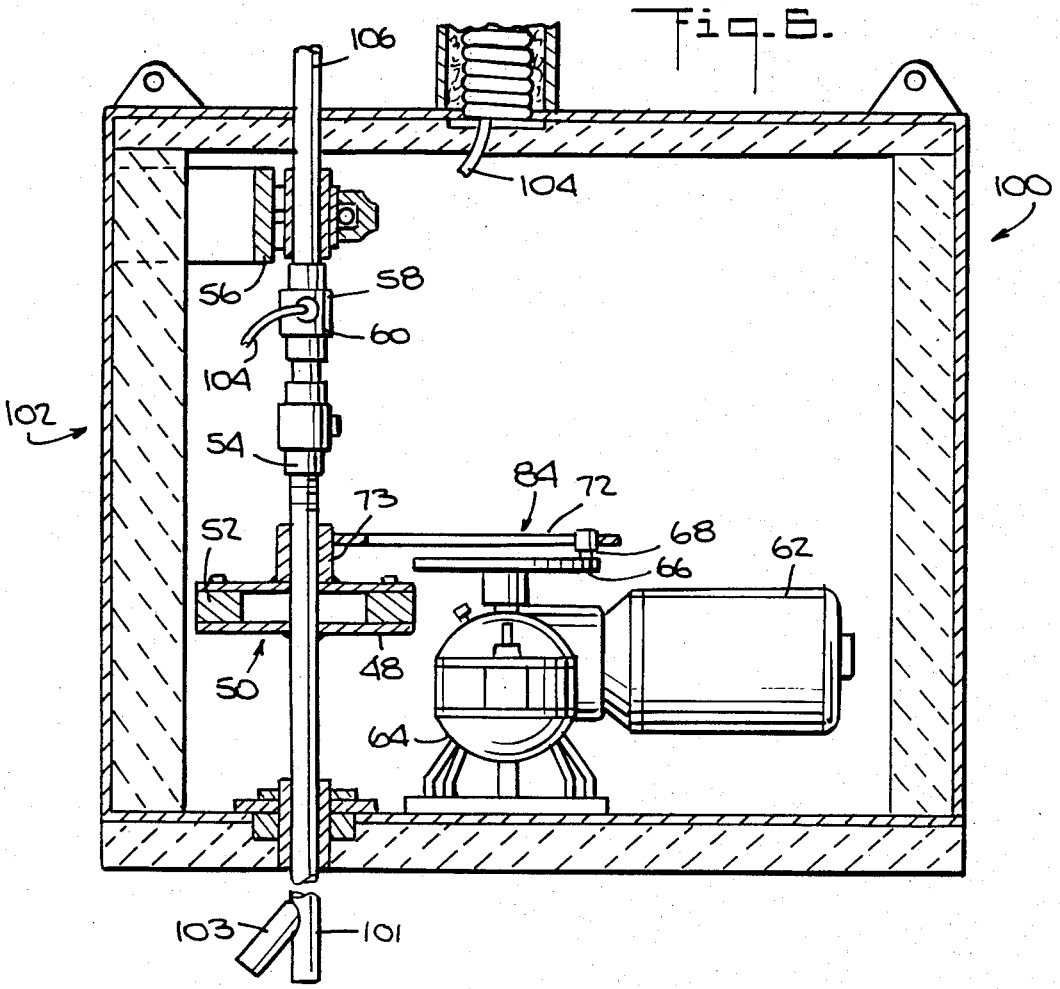
FIG. 6 is a cross sectional view taken through FIG. 5 along line 6—6.
Figure 7:
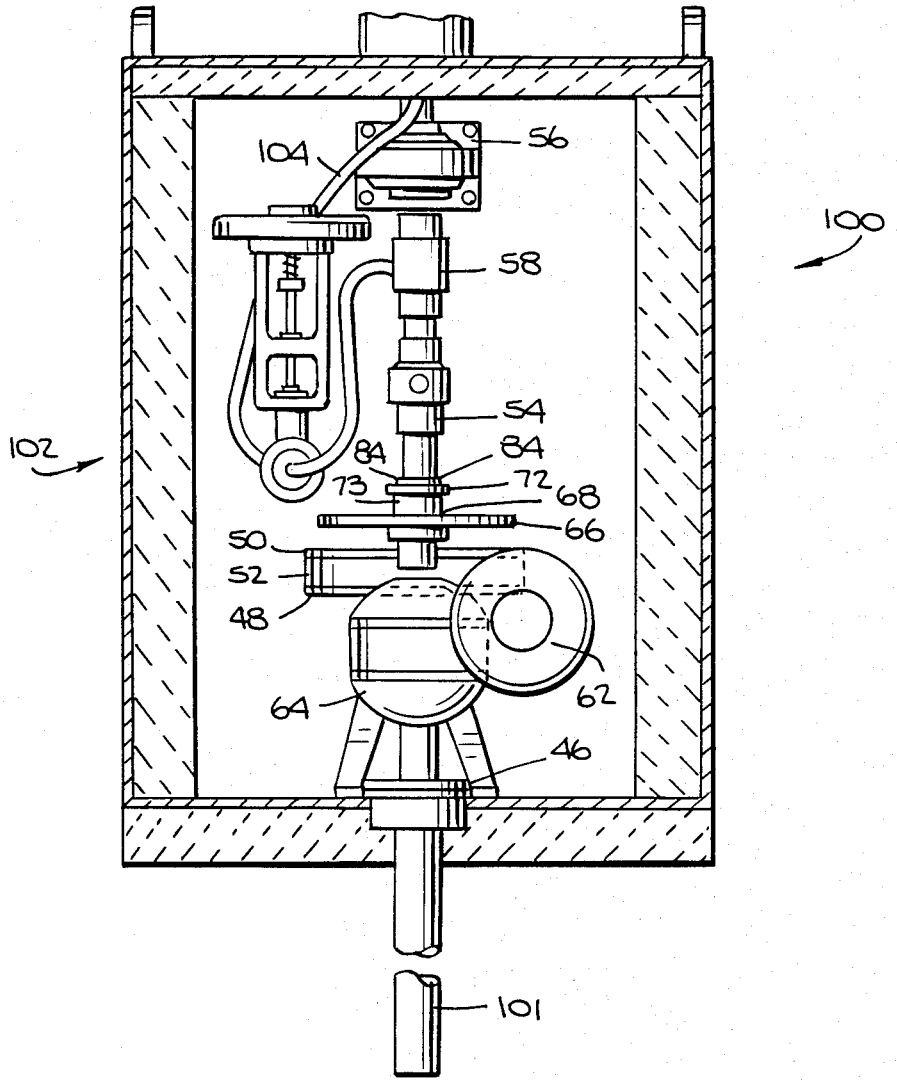
FIG. 7 is a cross sectional view taken through FIG. 6 along line 7—7.

Details of control box 102 and its contents are shown in FIGS. 5–7. Vertical conduit 101 extends into the bottom of control box 102 through thrust bearing 46 within which it is rotatable and which supports its weight. Lower clutch plate 48 of magnetic clutch 50 is secured to conduit 101 and the drive portion 52 of clutch 50 supported rotatably mounted upon conduit 101 below swivel coupling 54 which joins rotatable conduit 101 to refractory supply conduit 106 supported in sleeve mounting bracket 56. Refractory supply conduit 106 is connected to swivel coupling 54 by water supply Tee 58 having a connecting nipple 60 to which water supply conduit 104 is connected, thus comprising a mixing head.

Electric drive motor 62 having a geared reducing head 64 rotates crank disc 66 in a horizontal plane. Crank pin 68 or disc 66 is inserted in longitudinal slot 70 within lever 72 which is secured, for example, by welding to collar 73 connected to the drive portion 52 of clutch 50. Rotation of crank disc 66 accordingly oscillates drive portion 52 of clutch 50. The aforementioned driving components comprise, in combination, oscillating drive 84.

Figure 8:
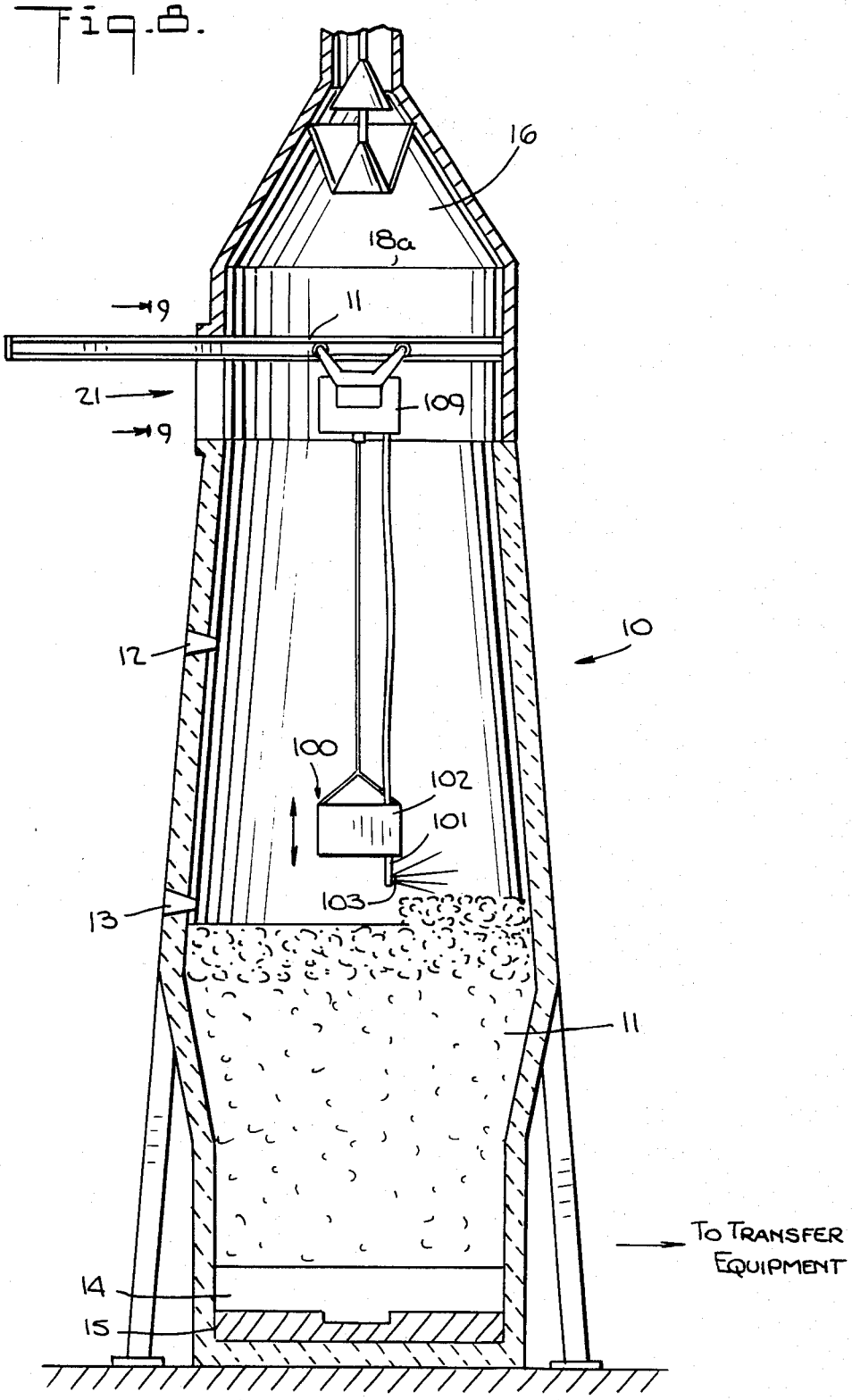
FIG. 8 depicts the gunning apparatus in the blast furnace.

FIG. 8 illustrates one embodiment of the process of the present invention. From this figure, it can be seen that the burden 11 in blast furnace 10 has been lowered to expose, for example, stack 12. Door 23 has been removed to expose reusable opening 21. Gantry 110 has been introduced through reusable opening 21 and remote controlled vertical refractory gunning apparatus has been introduced into the blast furnace.

FIG. 9 is a cross sectional view taken along line 9—9 of FIG. 8 and shows the relationship between gantry 110 and door frame 22. From FIG. 9, it can be seen that the gantry 110 comprises two side beams 110*a*, 110*b* which are bolted to door frame 22 by means of bolts 112 inserted into throughbores 24. It can also be seen that gantry 110 further comprises cross beams 110*c*, 110*d* along which cab 109 rides. Also seen in FIG. 9 is remote controlled vertical refractory gunning apparatus 100 extending from cab 109.

Figure 10:
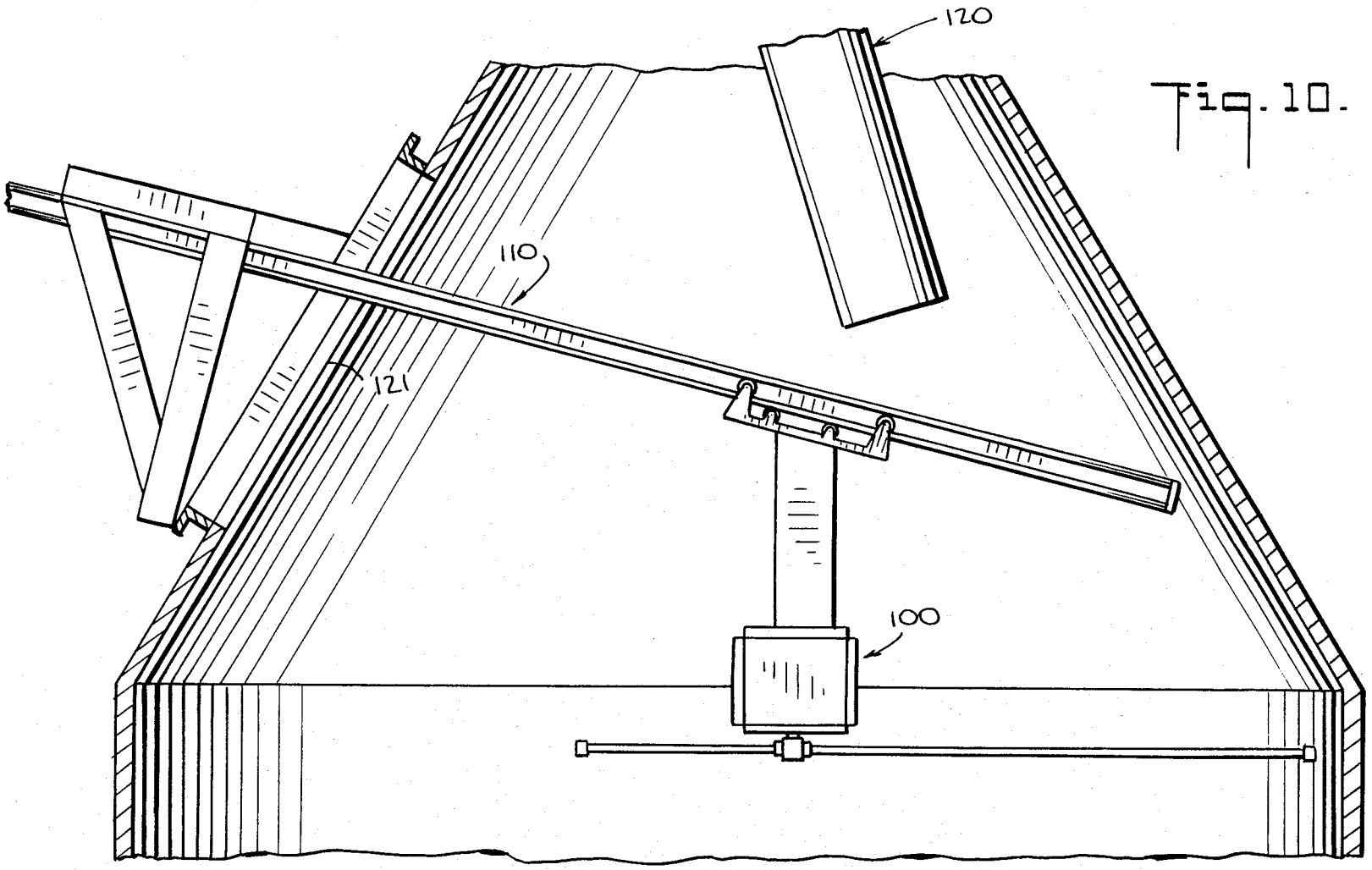
FIG. 10 depicts the gunning apparatus in a blast furnace with a chute top.

FIG. 10 illustrates the introduction of the vertical remote controlled refractory gunning apparatus into a blast furnace having chute means for the introduction of the burden of raw materials. From FIG. 10, it can be seen that chute 120 has been angularly disposed to one side and gantry 110 having vertical remote controlled refractory gunning device 100 has been introduced at an angle, preferably 25°, through the chute door 121, so as to clear chute 120 and allow vertical remote controlled gunning apparatus 100 to be introduced at the highest possible point in the blast furnace so as to enable repair work to be done to a maximum area of the furnace.

Alternatively, chute 120 may be removed from the blast furnace totally and gantry 110 may be introduced at a lesser angle since chute clearance is not necessary.

It can be seen that the process of the present invention offers an alternative to the present methods of repairing blast furnace. Since the process uses a remote controlled gunning device, it does not require the shutdown of the blast furnace. Thus, the procedure may be used for periodic maintenance of the blast furnace.

While the invention has been described in connection with a preferred embodiment, it also includes alternatives, modifications and equivalents within the spirit of the scope of the appended claims.

I claim:

1. A method of repairing an area of damages to the wall of the stack, bosh, or hearth of a blast furnace comprising (a) withdrawing raw material present in the blast furnace to a point below the area to be repaired, (b) creating a reusable opening in the side of said blast furnace, said opening located in the vicinity of the stock line of said furnace, (c) introducing through said opening a gantry supporting a vertical remote-controlled refractory gunning apparatus, said opening adapted to receive said gantry, said vertical remote-controlled refractory gunning apparatus comprising (i) a vertical gunning conduit, terminating at its lower extremity in a nozzle, (ii) a control unit, (iii) bearing means rotatably connecting and mounting said vertical gunning conduit from said control unit.

(iv) an oscillating drive in said control unit, (v) a drive coupling in said control unit connecting said oscillating drive to said vertical gunning conduit, (vi) supply conduits entering said control unit for supplying refractory material and water, (vii) a mixing head in said control unit to which said supply conduits are connected, (viii) a swivel coupling connecting said mixing head to said vertical gunning conduit for providing a mixture of water and refractory to said nozzle, and (ix) actuating means connected to said oscillating drive for selectively actuating it to control the angular orientation of said nozzle whereby said nozzle is angularly oriented about said vertical gunning conduit in stationary and oscillating modes of operation, (d) spraying refractory materials onto the area to be repaired.

2. A method according to claim 1 wherein said opening is a flanged doorway.

3. A process for the repair of an area of damages to the stack, bosh, or hearth of a blast furnace having chute means for the introduction of raw materials comprising:

(a) withdrawing raw materials present in said blast furnace to a point below the area to be repaired, (b) angularly disposing said chute means to one side, (c) introducing through the opening formed by said angular disposition of said angularly disposed chute means a gantry supporting a vertical remote controlled refractory gunning apparatus, said gantry introduced at a minimum angle to clear said chute, said vertical remote controlled refractory gunning apparatus comprising (i) a vertical gunning conduit, terminating at its lower extremity in a nozzle, (ii) a control unit, (iii) bearing means rotatably connecting and mounting said vertical gunning conduit from said control unit.

(iv) an oscillating drive in said control unit, (v) a drive coupling in said control unit connecting said oscillating drive to said vertical gunning conduit, (vi) supply conduits entering said control unit for supplying refractory material and water, (vii) a mixing head in said control unit to which said supply conduits are connected, (viii) a swivel coupling connecting said mixing head to said vertical gunning conduit for providing a mixture of water and refractory to said nozzle, and (ix) actuating means connected to said oscillating drive for selectively actuating it to control the angular orientation of said nozzle whereby said nozzle is angularly oriented about said vertical gunning conduit in stationary and oscillating modes of operation,

4. The method of claim 3 wherein said minimum angle is 25°.

* * * * *